US008063358B2

(12) United States Patent
Bateman et al.

(10) Patent No.: US 8,063,358 B2
(45) Date of Patent: Nov. 22, 2011

(54) MASS SPECTROMETER

(75) Inventors: Robert Harold Bateman, Cheshire (GB); Jeffery Mark Brown, Cheshire (GB); Martin Raymond Green, Cheshire (GB); Jason Lee Wildgoose, Stockport (GB)

(73) Assignee: Micromass UK Ltd., Manchester (GB)

( * ) Notice: Subject to any disclaimer, the term of this patent is extended or adjusted under 35 U.S.C. 154(b) by 612 days.

(21) Appl. No.: 11/916,430

(22) PCT Filed: Jun. 1, 2006

(86) PCT No.: PCT/GB2006/001996

§ 371 (c)(1), (2), (4) Date: May 13, 2008

(87) PCT Pub. No.: WO2006/129094

PCT Pub. Date: Dec. 7, 2006

(65) Prior Publication Data

US 2009/0114808 A1 May 7, 2009

Related U.S. Application Data

(60) Provisional application No. 60/688,004, filed on Jun. 7, 2005.

(30) Foreign Application Priority Data

Jun. 3, 2005 (GB) ..... 0511332.9

(51) Int. Cl.
*H01J 49/26* (2006.01)

(52) U.S. Cl. ..... 250/282; 250/281

(58) Field of Classification Search ..... 250/281, 250/282, 286, 287; 702/22, 26, 27, 28
See application file for complete search history.

(56) References Cited

U.S. PATENT DOCUMENTS

| | | | | |
|---|---|---|---|---|
| 5,121,443 | A * | 6/1992 | Tomlinson | 382/156 |
| 6,229,142 | B1 * | 5/2001 | Bateman et al. | 250/287 |
| 6,681,186 | B1 | 1/2004 | Denisov et al. | |
| 2003/0218129 | A1 * | 11/2003 | Rather | 250/282 |

FOREIGN PATENT DOCUMENTS

| | | |
|---|---|---|
| GB | 2390936 | 1/2004 |
| GB | 2403342 | 12/2004 |
| WO | 2004/102180 | 11/2004 |

* cited by examiner

*Primary Examiner* — Robert Kim
*Assistant Examiner* — Nicole Ippolito Rausch
(74) *Attorney, Agent, or Firm* — Micromass UK Ltd

(57) ABSTRACT

A method of mass spectrometry is disclosed wherein voltage signals from an ion detector are analyzed. A second differential of each voltage signal is obtained and the start and end times of observed voltage peaks are determined. The intensity and average time of each voltage peak is then determined and the intensity and time values are stored. An intermediate composite mass spectrum is then formed by combining the intensity and time values which relate to each voltage peak observed from multiple experimental runs. The various pairs of time and intensity data are then integrated to produce a smooth continuum mass spectrum. The continuum mass spectrum may then be further processed by determining the second differential of the continuum mass spectrum. The start and end times of mass peaks observed in the continuum mass spectrum may be determined. The intensity and mass to charge ratio of each mass peak observed in the continuum mass spectrum may then determined. A final discrete mass spectrum comprising just of an intensity value and mass to charge ratio per species of ion may then be displayed or output.

25 Claims, 7 Drawing Sheets

100
%
0
1055
1056
1056
1056

MASS SPECTROMETER

CROSS REFERENCE TO RELATED APPLICATIONS

This application is the National Stage of International Application No. PCT/GB2006/001996, filed on Jun. 1, 2006, which claims priority to and benefit of U.S. Provisional Patent Application Ser. No. 60/688,004, filed on Jun. 7, 2005, and priority to and benefit of United Kingdom Patent Application No. 0511332.9, filed Jun. 3, 2005. The entire contents of these applications are incorporated herein by reference.

The present invention relates to a mass spectrometer and a method of mass spectrometry.

A known method of obtaining a mass spectrum is to record the output signal from an ion detector of a mass analyser as a function of time using a fast Analogue to Digital Converter (ADC). It is known to use an Analogue to Digital Converter with a scanning magnetic sector mass analyser, a scanning quadrupole mass analyser or an ion trap mass analyser.

If a mass analyser is scanned very quickly for a relatively long period of time (e.g. over the duration of a chromatography separation experimental run) then it is apparent that very large amounts of mass spectral data will be acquired if an Analogue to Digital Converter is used. Storing and processing a large amount of mass spectral data requires a large memory which is disadvantageous. Furthermore, the large amount of data has the effect of slowing subsequent processing of the data. This can be particularly problematic for real time applications such as Data Dependent Acquisitions (DDA).

Due to the problems of using an Analogue to Digital Converter with a Time of Flight mass analyser it is common instead to use a Time to Digital Converter (TDC) detector system with a Time of Flight mass analyser. A Time to Digital Converter differs from an Analogue to Digital Converter in that a Time to Digital Converter records just the time that an ion is recorded as arriving at the ion detector. As a result Time to Digital Converters produce substantially less mass spectral data which makes subsequent processing of the data substantially easier. However, one disadvantage of a Time to Digital Converter is that they do not output an intensity value associated with an ion arrival event. Time to Digital Converters are therefore unable to discriminate between one or multiple ions arriving at the ion detector at substantially the same time.

Conventional Time of Flight mass analysers sum the ion arrival times as determined by a Time to Digital Converter system from multiple acquisitions. No data is recorded at times when no ions arrive at the ion detector. A composite histogram of the times of recorded ion arrival events is then formed. As more and more ions are added to the histogram from subsequent acquisitions the histogram progressively builds up to form a mass spectrum of ion counts versus flight time (or mass to charge ratio).

Conventional Time of Flight mass analysers may collect, sum or histogram many hundreds or even thousands of separate Time of Flight spectra obtained from separate acquisitions in order to produce a final composite mass spectrum. The mass spectrum or histogram of ion arrival events may then be stored to computer memory.

One disadvantage of conventional Time of Flight mass analysers is that many of the individual spectra which are histogrammed to a final mass spectrum may relate to acquisitions wherein only a few or no ion arrival events were recorded. This is particularly the case for orthogonal acceleration Time of Flight mass analysers operated at very high acquisition rates.

Known Time of Flight mass analysers comprise an ion detector comprising a secondary electron multiplier such as a microchannel plate (MCP) or discrete dynode electron multiplier. The secondary electron multiplier or discrete dynode electron multiplier generates a pulse of electrons in response to an ion arriving at the ion detector. The pulse of electrons or current pulse is then converted into a voltage pulse which may then be amplified using an appropriate amplifier.

State of the art microchannel plate ion detectors can produce a signal in response to the arrival of a single ion wherein the signal has a Full Width at Half Maximum of between 1 and 3 ns. A Time to Digital Converter (TDC) is used to detect the ion signal. If the signal produced by the electron multiplier exceeds a predefined voltage threshold then the signal may be recorded as relating to an ion arrival event. The ion arrival event is recorded just as a time value with no associated intensity information. The arrival time is recorded as corresponding to the time when the leading edge of the ion signal passes through the voltage threshold. The recorded arrival time will only be accurate to the nearest clock step of the Time to Digital Converter. A state of the art 10 GHz Time to Digital Converter is capable of recording ion arrival times to within ±50 ps.

One advantage of using a Time to Digital Converter to record ion arrival events is that any electronic noise can be effectively removed by applying a signal or voltage threshold. As a result, the noise does not appear in the final histogrammed mass spectrum and a very good signal to noise ratio can be achieved if the ion flux is relatively low.

Another advantage of using a Time to Digital Converter is that the analogue width of the signal generated by a single ion does not add to the width of the ion arrival envelope for a particular mass to charge ratio value in the final histogrammed mass spectrum. Since only ion arrival times are recorded the width of mass peaks in the final histogrammed mass spectrum is determined only by the spread in ion arrival times for each mass peak and by the variation in the voltage pulse height produced by an ion arrival event relative to the signal threshold.

However, an important disadvantage of conventional Time of Flight mass analysers comprising an ion detector including a Time to Digital Converter system is that the Time to Digital Converter is unable to distinguish between a signal arising due to the arrival of a single ion at the ion detector and that of a signal arising due to the simultaneous arrival of multiple ions at the ion detector. This inability to distinguish between single and multiple ion arrival events leads to a distortion of the intensity of the final histogram or mass spectrum. Furthermore, an ion arrival event will only be recorded if the output signal from the ion detector exceeds a predefined voltage threshold.

Known ion detectors which incorporate a Time to Digital Converter system also suffer from the problem that they exhibit a recovery time after an ion arrival event has been recorded during which time the signal must fall below the predetermined voltage signal threshold. During this dead time no further ion arrival events can be recorded.

At relatively high ion fluxes the probability of several ions arriving at the ion detector at substantially the same time during an acquisition can become relatively significant. As a result, dead time effects will lead to a distortion in the intensity and mass to charge ratio position in the final histogrammed mass spectrum. Known mass analysers which use a Time to Digital Converter detector system therefore suffer from the problem of having a relatively limited dynamic range for both quantitative and qualitative applications.

In contrast to the limitations of a Time to Digital Converter system, multiple ion arrival events can be accurately recorded using an Analogue to Digital Converter system. An Analogue to Digital Converter system can record the signal intensity at each clock cycle.

Known Analogue to Digital recorders can digitise a signal at a rate, for example, of 2 GHz whilst recording the intensity of the signal as a digital value of up to eight bits. This corresponds to an intensity value of 0-255 at each time digitisation point. Analogue to Digital Converters are also known which can record a digital intensity value at up to 10 bits, but such Analogue to Digital Converters tend to have a limited spectral repetition rate.

An Analogue to Digital Converter produces a continuum intensity profile as a function of time corresponding to the signal output from the electron multiplier. Time of Flight Spectra from multiple acquisitions can then be summed together to produce a final mass spectrum.

An advantageous feature of an Analogue to Digital Converter system is that an Analogue to Digital Converter system can output an intensity value and can therefore record multiple simultaneous ion arrival events by outputting an increased intensity value. In contrast, a Time to Digital Converter system is unable to discriminate between one or multiple ions arriving at the ion detector at substantially the same time.

Analogue to Digital Converters do not suffer from dead time effects which may be associated with a Time to Digital Converter which uses a detection threshold. However, Analogue to Digital Converters suffer from the problem that the analogue width of the signal from individual ion arrivals adds to the width of the ion arrival envelope. Accordingly, the mass resolution of the final summed or histogrammed mass spectrum may be reduced compared to a comparable mass spectrum produced using a Time to Digital Converter based system.

Analogue to Digital Converters also suffer from the problem that any electronic noise will also be digitised and will appear in each time of flight spectrum corresponding to each acquisition. This noise will then be summed and will be present in the final or histogrammed mass spectrum. As a result relatively weak ion signals can be masked and this can lead to relatively poor detection limits compared to those obtainable using a Time to Digital Converter based system.

It is desired to provide an improved mass spectrometer and method of mass spectrometry.

According to the present invention there is provided a method of mass spectrometry comprising:

digitising a first signal output from an ion detector to produce a first digitised signal;

determining or obtaining a second differential of the first digitised signal; and determining the arrival time of one or more ions from the second differential of the first digitised signal.

Preferably the first signal comprises an output signal, a voltage signal, an ion signal, an ion current, a voltage pulse or an electron current pulse.

An Analogue to Digital Converter or a transient recorder is preferably used to digitise the first signal. The Analogue to Digital Converter or transient recorder preferably comprises a n-bit Analogue to Digital Converter or transient recorder, wherein n comprises 8, 10, 12, 14 or 16. The Analogue to Digital Converter or transient recorder preferably has a sampling or acquisition rate selected from the group consisting of: (i)<1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz. Preferably the Analogue to Digital Converter or transient recorder has a digitisation rate which is substantially uniform. Alternatively, the Analogue to Digital Converter or transient recorder may have a digitisation rate which is substantially non-uniform.

The preferred method comprises subtracting a constant number or value from the first digitised signal. If a portion of the first digitised signal falls below zero after subtraction of a constant number or value from the first digitised signal then preferably the method further comprises resetting the portion of the first digitised signal to zero. In one set of embodiments the method comprises determining whether a portion of the first digitised signal falls below a threshold and resetting the portion of the first digitised signal to zero if the portion of the first digitised signal falls below the threshold.

Preferably, the method comprises smoothing the first digitised signal. A moving average, boxcar integrator, Savitsky Golay or Hites Biemann algorithm may be used to smooth the first digitised signal.

The step of determining the arrival time of one or more ions from the second differential of the first digitised signal preferably comprises determining one or more zero crossing points of the second differential of the first digitised signal. This method may further comprise determining or setting a start time t1 of an ion arrival event as corresponding to a digitisation interval which is immediately prior or subsequent to the time when the second differential of the first digitised signal falls below zero or another value. The preferred method further comprises determining or setting an end time t2 of an ion arrival event as corresponding to a digitisation interval which is immediately prior or subsequent to the time when the second differential of the first digitised signal rises above zero or another value.

Preferably, the method further comprises determining the intensity of one or more peaks present in the first digitised signal which correspond to one or more ion arrival events. The step of determining the intensity of one or more peaks present in the first digitised signal preferably comprises determining the area of the one or more peaks present in the first digitised signal bounded by the start time t1 and/or by the end time t2.

Preferably, the method further comprises determining the moment of one or more peaks present in the first digitised signal which correspond to one or more ion arrival events. The step of determining the moment of one or more peaks present in the first digitised signal which correspond to one or more ion arrival events preferably comprises determining the moment of a peak bounded by the start time t1 and/or by the end time t2.

The preferred method comprises determining the centroid time of one or more peaks present in the first digitised signal which correspond to one or more ion arrival events. Preferably, the method further comprises determining the average or representative time of one or more peaks present in the first digitised signal which correspond to one or more ion arrival events.

Preferably, the method further comprises storing or compiling a list of the average or representative times and/or intensities of one or more peaks present in the first digitised signal which correspond to one or more ion arrival events.

According to a preferred embodiment, the method further comprises:

digitising one or more further signals output from the ion detector to produce one or more further digitised signals;

determining or obtaining a second differential of the one or more further digitised signals; and determining the arrival time of one or more ions from the second differential of the one or more further digitised signals.

Preferably, the one or more further signals comprise one or more output signals, voltage signals, ion signals, ion currents, voltage pulses or electron current pulses.

An Analogue to Digital Converter or a transient recorder is preferably used to digitise the one or more further signals. The Analogue to Digital Converter or transient recorder preferably comprises a n-bit Analogue to Digital Converter or transient recorder, wherein n comprises 8, 10, 12, 14 or 16. Preferably, the Analogue to Digital Converter or transient recorder has a sampling or acquisition rate selected from the group consisting of: (i) <1 GHz; (ii) 1-2 GHz; (iii) 2-3 GHz; (iv) 3-4 GHz; (v) 4-5 GHz; (vi) 5-6 GHz; (vii) 6-7 GHz; (viii) 7-8 GHz; (ix) 8-9 GHz; (x) 9-10 GHz; and (xi) >10 GHz. The Analogue to Digital Converter or transient recorder preferably has a digitisation rate which is substantially uniform. Alternatively, the Analogue to Digital Converter or transient recorder has a digitisation rate which is substantially non-uniform.

Preferably, the step of digitising the one or more further signals comprises digitising at least 5, 10, 15, 20, 25, 30, 35, 40, 45, 50, 55, 60, 65, 70, 75, 80, 85, 90, 95, 100, 200, 300, 400, 500, 600, 700, 800, 900, 1000, 2000, 3000, 4000, 5000, 6000, 7000, 8000, 9000 or 10000 signals from the ion detector, each signal corresponding to a separate experimental run or acquisition.

The preferred method further comprises subtracting a constant number or value from at least some or each of the one or more further digitised signals. If a portion of at least some or each of the one or more further digitised signals falls below zero after subtraction of a constant number or value from the one or more further digitised signals then the method preferably further comprises resetting the portion of the one or more further digitised signals to zero. In one set of embodiments the method comprises determining whether a portion of the one or more further digitised signal falls below a threshold and resetting the portion of the one or more further digitised signals to zero if the portion of the one or more further digitised signals falls below the threshold.

The preferred method further comprises smoothing the one or more further digitised signals, preferably by using a moving average, boxcar integrator, Savitsky Golay or Hites Biemann algorithm. The step of determining the arrival time of one or more ions from the second differential of the one or more further digitised signals preferably comprises determining one or more zero crossing points of the second differential of the one or more further digitised signals.

The method preferably further comprises determining or setting a start time tn1 of an ion arrival event as corresponding to a digitisation interval which is immediately prior or subsequent to the time when the second differential of the one or more further digitised signals falls below zero or another value. Preferably, the method comprises determining or setting an end time tn2 of an ion arrival event as corresponding to a digitisation interval which is immediately prior or subsequent to the time when the second differential of the one or more further digitised signals rises above zero or another value.

The preferred method further comprises determining the intensity of the one or more peaks present in the one or more further digitised signals which correspond to one or more ion arrival events. The step of determining the intensity of one or more peaks present in the one or more further digitised signals preferably comprises determining the area of the peak present in the one or more further digitised signals bounded by the start time tn1 and/or the end time tn2.

Preferably, the moment of one or more peaks present in the one or more further digitised signals which correspond to one or more ion arrival events is also determined. The step of determining the moment of the one or more peaks present in the one or more further digitised signals which correspond to one or more ion arrival events preferably comprises determining the moment of the one or more further digitised signals bounded by the start time tn1 and/or the end time tn2.

The centroid time of the one or more peaks present in the one or more further digitised signals which correspond to one or more ion arrival events is preferably also determined.

Preferably, the method comprises determining the average or representative time of one or more peaks present in the one or more further digitised signals which correspond to one or more ion arrival events.

The preferred method comprises storing or compiling a list of the average or representative times and/or intensities of the one or more further digitised signals which correspond to one or more ion arrival events.

Preferably, the method further comprises combining or integrating data relating to the average or representative time and/or intensity of the first digitised signal relating to one or more ion arrival events with data relating to the average or representative times and/or intensities of the one or more further digitised signals relating to one or more ion arrival events. Preferably, a moving average integrator algorithm, boxcar integrator algorithm, Savitsky Golay algorithm or Hites Biemann algorithm is used to combine or integrate data relating to the average or representative time and/or intensity of the first digitised signal relating to one or more ion arrival events with data relating to the average or representative times and/or intensities of the one or more further digitised signals relating to one or more ion arrival events.

According to the preferred embodiment, the method further comprises providing or forming a continuum mass spectrum. Preferably, a second differential of the continuum mass spectrum is determined or obtained. The method preferably further comprises determining the mass or mass to charge ratio of one or more ions or mass peaks from the second differential of the continuum mass spectrum. The step of determining the mass or mass to charge ratio of one or more ions or mass peaks from the second differential of the continuum mass spectrum preferably comprises determining one or more zero crossing points of the second differential of the continuum mass spectrum. Preferably, the method further comprises determining or setting a start point T1 of a mass peak as corresponding to a stepping interval which is immediately prior or subsequent to the point when the second differential of the continuum mass spectrum falls below zero or another value. The method preferably also comprises determining or setting an end point T2 of a mass peak as corresponding to a stepping interval which is immediately prior or subsequent to the point when the second differential of the continuum mass spectrum rises above zero or another value.

The preferred method further comprises determining the intensity of one or more ions or mass peaks from the continuum mass spectrum. The step of determining the intensity of one or more ions or mass peaks from the continuum mass spectrum preferably comprises determining the area of a mass peak bounded by the start point T1 and/or the end point T2.

The preferred method further comprises determining the moment of one or more ions or mass peaks from the continuum mass spectrum. The step of determining the moment of one or more ions or mass peaks from the continuum mass spectrum preferably comprises determining the moment of a mass peak bounded by the start point T1 and/or the end point T2.

Preferably, the centroid time of one or more ions or mass peaks from the continuum mass spectrum is determined. The average or representative time of one or more ions or mass peaks from the continuum mass spectrum may also be determined.

The preferred method further comprises displaying or outputting a mass spectrum. Preferably, the mass spectrum comprises a plurality of mass spectral data points wherein each data point is considered as representing a species of ion and wherein each data point comprises an intensity value and a mass or mass to charge ratio value.

According to a preferred set of embodiments the ion detector comprises a microchannel plate, a photomultiplier or an electron multiplier device. The ion detector preferably further comprises a current to voltage converter or amplifier for producing a voltage pulse in response to the arrival of one or more ions at the ion detector.

The method preferably further comprises providing a mass analyser. The mass analyser preferably comprises: (i) a Time of Flight ("TOF") mass analyser; (ii) an orthogonal acceleration Time of Flight ("oaTOF") mass analyser; or (iii) an axial acceleration Time of Flight mass analyser. Alternatively, the mass analyser may be selected from the group consisting of: (i) a magnetic sector mass spectrometer; (ii) a Paul or 3D quadrupole mass analyser; (iii) a 2D or linear quadrupole mass analyser; (iv) a Penning trap mass analyser; (v) an ion trap mass analyser; and (vi) a quadrupole mass analyser.

According to the present invention there is also provided an apparatus comprising:

means arranged to digitise a first signal output from an ion detector to produce a first digitised signal;

means arranged to determine or obtain a second differential of the first digitised signal; and means arranged to determine the arrival time of one or more ions from the second differential of the first digitised signal.

Preferably, the apparatus comprises an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source. The ion source may be continuous or pulsed.

The apparatus preferably further comprises a mass analyser. The mass analyser may comprise: (i) a Time of Flight ("TOF") mass analyser; (ii) an orthogonal acceleration Time of Flight ("oaTOF") mass analyser; or (iii) an axial acceleration Time of Flight mass analyser. Alternatively, the mass analyser is selected from the group consisting of: (i) a magnetic sector mass spectrometer; (ii) a Paul or 3D quadrupole mass analyser; (iii) a 2D or linear quadrupole mass analyser; (iv) a Penning trap mass analyser; (v) an ion trap mass analyser; and (vi) a quadrupole mass analyser.

According to a preferred embodiment, the apparatus further comprises a collision, fragmentation or reaction device. The collision, fragmentation or reaction device is preferably arranged to fragment ions by Collisional Induced Dissociation ("CID"). Alternatively, the collision, fragmentation or reaction device is selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

According to a preferred embodiment, a mass spectrometer is provided comprising an apparatus as described above.

According to another aspect of the present invention there is provided a method of mass spectrometry comprising:

providing a plurality of pairs of data, each pair of data comprising a time, mass or mass to charge ratio value and a corresponding intensity value; and combining or integrating at least some of the pairs of data to produce a mass spectrum, continuum mass spectrum or discrete mass spectrum.

According to another aspect of the present invention there is provided an apparatus comprising:

means arranged to provide a plurality of pairs of data, each pair of data comprising a time, mass or mass to charge ratio value and a corresponding intensity value; and means arranged to combine or integrate at least some of the pairs of data to produce a mass spectrum, continuum mass spectrum or discrete mass spectrum.

According to the preferred embodiment of the present invention multiple time of flight spectra are acquired by a Time of Flight mass analyser comprising an ion detector which incorporates an Analogue to Digital Converter. Detected ion signals are preferably amplified and converted into a voltage signal. The voltage signal is then preferably digitised using a fast Analogue to Digital Converter. The digitised signal is then preferably processed.

The start time of discrete voltage peaks present in the digitised signal which correspond to one or more ions arriving at the ion detector are preferably determined. Similarly, the end time of each discrete voltage peak is also preferably determined. The intensity and moment of each discrete voltage peak is preferably determined. The determined start time and/or end time of each voltage peak, the intensity of each voltage peak and the moment of each voltage peak are preferably used or stored for further processing.

Data from subsequent acquisitions is then preferably processed in a similar manner. Once multiple acquisitions have been performed the data from multiple acquisitions is then preferably combined and a list of times and corresponding intensity values relating to ion arrival events is preferably formed, created or compiled. The times and corresponding intensity values from multiple acquisitions are then preferably integrated so as to form a continuous or continuum mass spectrum.

The continuous or continuum mass spectrum is preferably further processed. The intensity and mass to charge ratio of mass peaks present in the continuous or continuum mass spectrum are preferably determined. A mass spectrum comprising the mass to charge ratio of ions and corresponding intensity values is preferably generated.

According to the preferred embodiment a second differential of the ion or voltage signal which is preferably output from the ion detector is preferably determined. The start time of voltage peaks present in the ion or voltage signal is preferably determined as being the time when the second differential of the digitised signal falls below zero. Similarly, the end time of voltage peaks is preferably determined as being the time when the second differential of the digitised signal rises above zero.

According to a less preferred embodiment the start time of a voltage peak may be determined as being the time when the digitised signal rises above a pre-defined threshold value. Similarly, the end time of a voltage peak may be determined as being the time when the digitised signal subsequently falls below a pre-defined threshold value.

The intensity of a voltage peak is preferably determined from the sum of all digitised measurements bounded by the determined start time of the voltage peak and ending with the determined end time of the voltage peak.

The moment of the voltage peak is preferably determined from the sum of the product of each digitised measurement and the number of digitisation time intervals between the digitised measurement and the start time of the voltage peak, or the end time of the voltage peak, for all digitised measurements bounded by the start time and the end time of the voltage peak.

Alternatively, the moment of the voltage peak may be determined from the sum of the running intensity of the voltage peak as the peak intensity is progressively computed, time interval by time interval, by the addition of each successive digitisation measurement, from the start time of the voltage peak to the end time of the voltage peak.

The start time and/or the end time of each voltage peak, the intensity of each voltage peak and the moment of each voltage peak from each acquisition are preferably recorded and are preferably used.

The start time and/or the end time of a voltage peak, the intensity of the voltage peak and the moment of the voltage peak are preferably used to calculate a representative or average time of flight for the one or more ions detected by the ion detector. The representative or average time of flight may then preferably be recorded or stored for further processing.

The representative or average time of flight for the one or more ions may be determined by dividing the moment of the voltage peak by the intensity of the voltage peak in order to determine the centroid time of the voltage peak. The centroid time of the voltage peak may then be added to the start time of the voltage peak, or may be subtracted from the end time of the voltage peak, as appropriate. Advantageously, the representative or average time of flight may be calculated to a higher precision than that of the digitisation time interval.

The representative or average time of flight and the corresponding intensity value associated with each voltage peak from each acquisition is preferably stored. Data from multiple acquisitions is then preferably assembled or combined into a single data set comprising time and corresponding intensity values.

The single data set comprising representative or average time of flight and corresponding intensity values from multiple acquisitions is then preferably processed such that the data is preferably integrated to form a single continuous or continuum mass spectrum. According to an embodiment the time and intensity pairs may be integrated using an integrating algorithm. The data may according to an embodiment be integrated by one or more passes of a box car integrator, a moving average algorithm, or another integrating algorithm.

The resultant single continuous or continuum mass spectrum preferably comprises a continuum of intensities at uniform or non-uniform time, mass or mass to charge ratio intervals. If the single continuous or continuum mass spectrum comprises a continuum of intensities at uniform time intervals then these time intervals may or may not correspond with a simple fraction or integral multiple of the digitisation time intervals of the Analogue to Digital Converter.

According to the preferred embodiment the frequency of intensity data intervals is preferably such that the number of intensity data intervals across a mass peak is greater than four, more preferably greater than eight. According to an embodiment the number of intensity data intervals across a mass peak may be sixteen or more.

The resultant single continuous or continuum mass spectrum may then preferably be further processed such that the mass spectral data is preferably reduced to time of flight, mass or mass to charge ratio values corresponding intensity values.

According to the preferred embodiment the single continuous or continuum mass spectrum is preferably processed in a similar manner to the way that the voltage signal from each acquisition is preferably processed in order to reduce the continuous or continuum mass spectrum to a plurality of time of flight and associated intensity values. A discrete mass spectrum may be produced or output.

According to the preferred embodiment the start time or point of each mass or data peak observed in the continuum mass spectrum is preferably determined. Similarly, the end time or point of each mass or data peak is also preferably determined. The intensity of each mass or data peak is then preferably obtained. The moment of each mass or data peak is also preferably obtained. The time of flight of each mass or data peak is preferably obtained from the start time or point of the mass or data peak and/or the end time or point of the mass data peak, the data peak composite intensity and the composite moment of the mass or data peak.

The start time or point of a mass or data peak may be determined as being the time when the continuous or continuum mass spectrum rises above a pre-defined threshold value. The subsequent end time or point of a mass or data peak may be determined as being the time when the continuous or continuum mass spectrum falls below a pre-defined threshold value.

Alternatively, the start time or point of a mass or data peak may be determined as being the time or point when the second differential of the continuous or continuum mass spectrum falls below zero. Similarly, the end time or point of a mass or data peak may be determined as being the time or point when the second differential of the continuous or continuum mass spectrum subsequently rises above zero.

The composite intensity of a mass or data peak may be determined from the sum of the intensities of all the mass or data points bounded by the start time or point of the mass or data peak and the end time or point of the mass or data peak.

A composite moment of each mass or data peak is preferably determined from the sum of the product of each mass or data point intensity and the time difference between the mass or data peak time of flight and the start time or point or end time or point, for all mass or data point bounded by the start time or point and the end time or point of the mass or data peak.

The time of flight of a data or mass peak may be determined from dividing the composite moment of the mass or data peak by the composite intensity of the mass or data peak to determine the centroid time of the mass or data peak. The centroid time of a mass or data peak is then preferably added to the start time or point of the mass or data peak, or is subtracted from the end time or point of the mass or data peak, as appropriate. The time of flight of the mass or data peak may be calculated to a higher precision than that of a digitisation time interval and to a higher precision than that of each mass or data peak.

The set of times of flight of mass or data peaks and corresponding intensity values may then be converted into a set of mass or mass to charge ratio values and corresponding intensity values. The conversion of time of flight data to mass or mass to charge ratio data may be performed by converting the data using a relationship derived from a calibration procedure and as such is well known in the art.

Various embodiments of the present invention will now be described, by way of example only, and with reference to the accompanying drawings in which.

Figure 1:
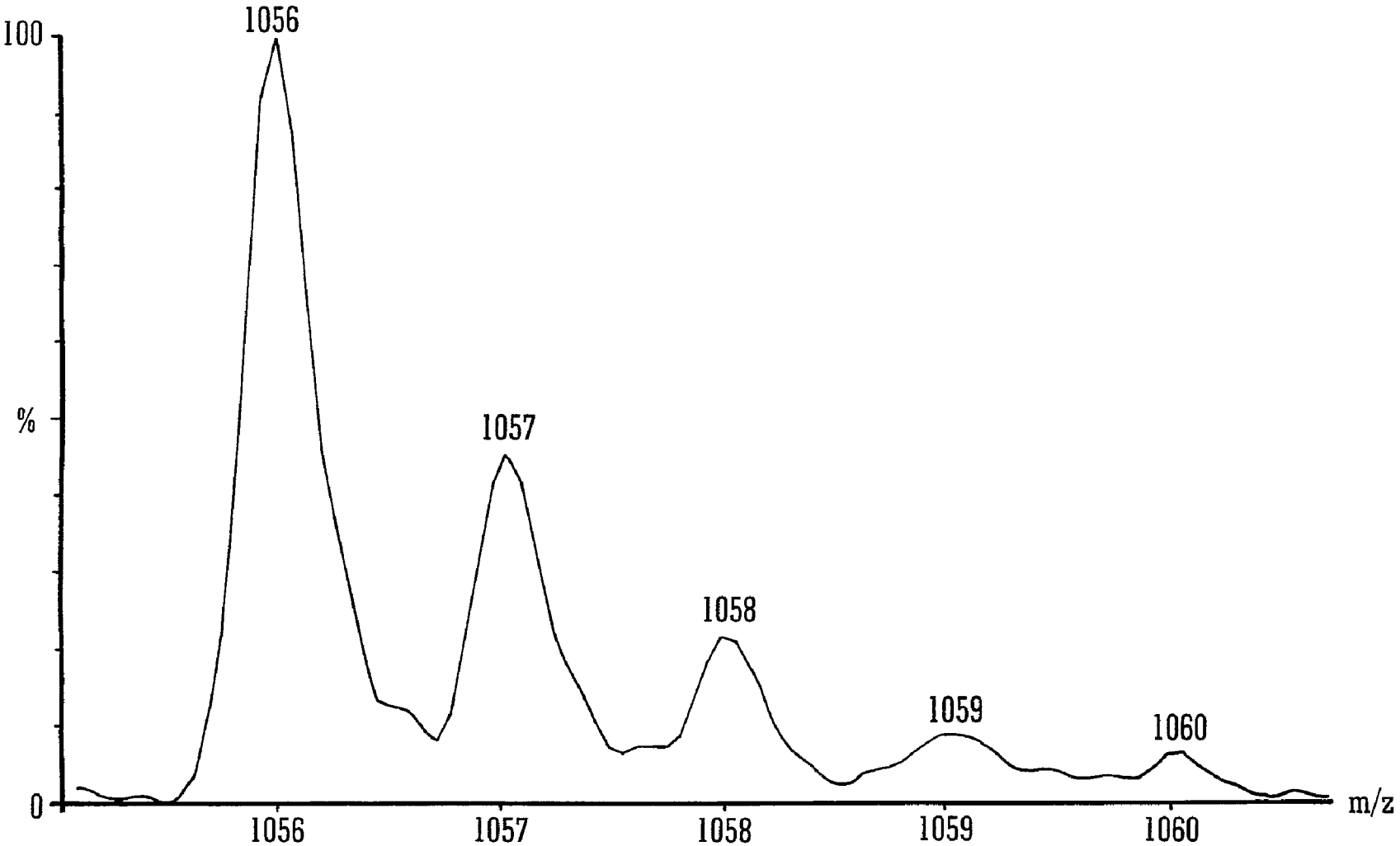
FIG. 1 shows a portion of a raw unprocessed mass spectrum of polyethylene glycol acquired by ionising a sample using a MALDI ion source and mass analysing the resulting ions using an orthogonal acceleration Time of Flight mass analyser.

The preferred embodiment relates to a method of mass spectrometry. A Time of Flight mass analyser is preferably provided which preferably comprises a detector system incorporating an Analogue to Digital Converter rather than a conventional Time to Digital Converter. Ions are preferably mass analysed by the Time of Flight mass analyser and the ions are preferably detected by an ion detector. The ion detector preferably comprises a microchannel plate (MCP) electron multiplier assembly. A current to voltage converter or amplifier is preferably provided which produces a voltage pulse or signal in response to a pulse of electrons being output from the microchannel plate ion detector. The voltage pulse or signal in response to the arrival of a single ion at the ion detector preferably has a width of between 1 and 3 ns at half height.

The voltage pulse or signal resulting from the arrival of one or more ions at the ion detector of the Time of Flight mass analyser is preferably digitised using, for example, a fast 8-bit transient recorder or Analogue to Digital Converter (ADC). The sampling rate of the transient recorder or Analogue to Digital Converter is preferably 1 GHz or faster.

The voltage pulse or signal may be subjected to signal thresholding wherein a constant number or value is preferably subtracted from each output number from the Analogue to Digital Converter in order to remove the majority of any Analogue to Digital Converter noise. If the signal becomes negative following subtraction of the constant number or value then that portion of the signal is preferably reset to zero.

A smoothing algorithm such as a moving average or boxcar integrator algorithm may preferably be applied to the data. Alternatively, a Savitsky Golay algorithm, a Hites Biemann algorithm or another type of smoothing algorithm may be used. For example, single pass of a moving average smooth with a window of three digitisation intervals is given by:

$$s(i)=m(i-1)+m(i)+m(i+1) \quad (1)$$

wherein m(i) is the intensity value in bits recorded in Analogue to Digital Converter time bin i and s(i) is the result of the smoothing procedure.

Multiple passes of a smoothing algorithm may be applied to the data. A second differential of the preferably smoothed data is then preferably obtained or determined.

The zero crossing points of the second differential are preferably determined and are preferably used to indicate or determine the start time and the end time of each observed voltage peak or ion signal peak. This method of peak location is particularly advantageous if the noise level is not constant throughout the time of flight spectrum or if the noise level fluctuates between individual time of flight spectra.

A simple difference calculation with a moving window of three digitisation intervals will produce a first differential of the digitised signal D1(*i*) which can be expressed by the equation:

$$D1(i)=s(i+1)-s(i-1) \quad (2)$$

wherein s(i) is the result of any smoothing procedure entered for time bin i.

The difference calculation is then preferably repeated, preferably with a moving window of three digitisation intervals. Accordingly, the second differential D2(*i*) of the first differential D1(*i*) will be produced. This may be expressed by the equation:

$$D2(i)=D1(i+1)-D1(i-1) \quad (3)$$

The second differential may therefore be expressed by the equation:

$$D2(i)=s(i+2)-2\cdot s(i)+s(i-2) \quad (4)$$

This difference calculation may be performed with a different width of moving window. The width of the difference window relative to that of the voltage pulse width at half height is preferably between 33% and 100%, and more preferably about 67%.

The second differential D2(*i*) is preferably integrated to locate or determine the start and end times of observed voltage peaks. The start time t1 of a voltage peak may be taken to be the digitisation interval immediately after the second differential falls below zero. The end time t2 of the voltage peak may be taken to be the digitisation interval immediately before the second differential rises above zero. Alternatively, the start time t1 of a voltage peak may be taken to be the digitisation interval immediately before the second differential falls below zero and the end time t2 of the voltage peak may be taken to be the digitisation interval immediately after the second differential rises above zero.

In a less preferred embodiment the voltage peak start time t1 may be derived from the digitisation time when the value of the Analogue to Digital Converter output m(i) rises above a threshold level. Similarly, the voltage peak end time t2 may be derived from the digitisation time when the value of the Analogue to Digital Converter output m(i) falls below a threshold level.

Once the start and the end times of a voltage peak or ion signal peak have been determined then the intensity and moment of the voltage peak or ion signal peak bounded by the start and end times can then preferably be determined.

The peak intensity of the voltage or ion signal preferably corresponds to the area of the signal and is preferably described by the following equation:

$$I = \sum_{i=t1}^{i=t2} m_i \tag{5}$$

wherein I is the determined voltage peak intensity, $m_i$ is the intensity value in bits recorded in Analogue to Digital Converter time bin i, t1 is the number of the Analogue to Digital Converter digitisation time bin at the start of the voltage peak and t2 is the number of the Analogue to Digital Converter digitisation time bin at the end of the voltage peak.

The moment $M_1$ with respect to the start of the voltage peak is preferably described by the following equation:

$$M_1 = \sum_{i=t1}^{i=t2} m_i \cdot i \tag{6}$$

The moment $M_2$ with respect to the end of the voltage peak may be described by the following equation:

$$M_2 = \sum_{i=t1}^{i=t2} m_i \cdot (\delta t - i + 1) \tag{7}$$

where $\delta t = (t2 - t1)$

The calculation of the moment $M_2$ with respect to the end of the peak is of particular interest. It may alternatively be calculated using the following equation:

$$M_2 = \sum_{i} \sum_{i=t1}^{i=t2} m_i \tag{8}$$

This latter equation presents the computation in a form that is very fast to execute. It may be rewritten in the form:

$$M_2 = \sum_{i=t1}^{i=t2} I_i \tag{9}$$

where $I_i$ is the intensity calculated at each stage in executing Eqn. 5.

The moment can therefore be computed as the intensity is being computed. The moment is preferably obtained by summing the running total for the intensity at each stage in computing the intensity.

Calculations of this sort may according to the preferred embodiment be performed very rapidly using Field Programmable Gate Arrays (FPGAs) in which calculations on large arrays of data may be performed in an essentially parallel fashion.

The calculated intensity and moment values and the number of the time bin corresponding to the start and/or the end of the voltage peak or ion signal are preferably recorded for further processing.

The centroid time $C_1$ of the voltage peak with respect to the start of the peak may be calculated from:

$$C_1 = \frac{M_1}{I} \tag{10}$$

If the time bin recorded as the start of the voltage peak is t1, then the representative or average time t associated with the voltage peak is:

$$t = t1 + C_1 \tag{11}$$

On the other hand the centroid time $C_2$ of the voltage peak with respect to the end of the peak may be calculated from:

$$C_2 = \frac{M_2}{I} \tag{12}$$

If the time bin recorded as the end of the voltage peak is t2 then the representative or average time t associated with the voltage peak is:

$$t = t2 - C_2 \tag{13}$$

The precision of the calculated value of t is dependent upon the precision of the division computed in Eqn. 10 or 12. The division calculation is relatively slow compared to the other calculations in this procedure and the higher the required precision the longer the calculation takes.

According to an embodiment the values of t1 and/or t2, I and $M_1$ or $M_2$ may be recorded and the value of t may be calculated off line. This approach allows t to be computed to whatever precision is required. Nevertheless, it may also be practical in some circumstances to calculate the value of t in real time.

The values of the average time t and intensity I for each voltage peak or ion signal are preferably stored as a list within a computer memory.

A single time of flight spectra may comprise voltage signals due to multiple ion arrivals. Each voltage signal is preferably converted to produce a time value and an intensity value. The time and intensity value is then preferably stored in a list.

According to the preferred embodiment further spectra are obtained and each spectra is preferably processed according to the preferred embodiment. The times and intensities generated from each subsequent time of flight experiments are then preferably added to the list.

After a certain number of time of flight spectra have been recorded, the individual values of time and intensity are preferably combined or integrated in such a way as to retain the precision of each individual measurements. The combined list may then be displayed as a single continuum mass spectrum.

In the preferred embodiment, the list of voltage peak intensity and average or representative time of flight pairs is preferably analysed to determine the presence of mass peaks. The intensity, time of flight and mass of each mass or mass to charge ratio peak is then preferably determined enabling a mass spectrum to be produced.

The preferred method of detecting the presence of mass peaks within the list of voltage intensity time pairs is to use a difference calculation so as to obtain the second differential. However, before this can be calculated the data must first be processed to form a continuum mass spectrum using an integrating algorithm.

According to the preferred embodiment the intensity and time of flight values resulting from multiple spectra are preferably assembled into a single list. The composite set of data is then preferably processed using, for example, a moving average or boxcar integrator algorithm. The moving window preferably has a width in time of W(t) and the increment in time by which the window is stepped is S(t). Both W(t) and S(t) may be assigned values which are completely independent of each other and completely independent of the Analogue to Digital Converter digitisation interval. Both W(t) and S(t) may have constant values or may be a variable function of time.

According to the preferred embodiment the width of the integration window W(t) relative to the width of the mass peak at half height is preferably between 33% and 100%, and more preferably about 67%. The step interval S(t) is preferably such that the number of steps across the mass peak is at least four, or more preferably at least eight, and even more preferably sixteen or more.

Intensity data within each window is preferably summed and each intensity sum is preferably recorded along with the time interval corresponding to the step at which the sum is computed.

If n is the number of steps of the stepping interval S(t) for which the time is T(n), the sum G(n) from the first pass of a simple moving average or boxcar integrator algorithm is given by:

$$G(n) = \sum_{t=T(n)-0.5.W(T)}^{t=T(n)+0.5.W(T)} I(t) \tag{14}$$

wherein T(n) is the time after n steps of the stepping interval S(t), I(t) is the intensity of a voltage peak recorded with an average or representative time of flight t, W(T) is the width of the integration window at time T(n), and G(n) is the sum of all voltage peak intensities with a time of flight within the integration window W(T) centered about time T(n).

According to an embodiment multiple passes of the integration algorithm may be applied to the data. A smooth continuum composite data set is then preferably provided then this composite data set or continuum mass spectrum may then preferably be further analysed.

According to the preferred embodiment a second differential of the smooth continuum composite data set or continuum mass spectrum may be determined.

The zero crossing points of the second differential of the continuum mass spectrum are preferably determined. The zero crossing points of the second differential indicate the start time and the end time of mass peaks in the composite continuum data set or mass spectrum.

The first and second differentials can be determined by two successive difference calculations. For example, a difference calculation with a moving window of 3 step intervals which will produce a first differential H1($n$) of the continuum data G and may be expressed by the equation:

$$H1(n)=G(n+1)-G(n-1) \tag{15}$$

wherein G(n) is the final sum of one or more passes of the integration algorithm at step n.

If this simple difference calculation is repeated, again with a moving window of 3 digitisation intervals, this will produce a second differential H2($n$) of the first differential H1($n$). This may be expressed by the equation:

$$H2(i)=H1(i+1)-H1(i-1) \tag{16}$$

The combination of the two difference calculations may be expressed by the equation:

$$H2(n)=G(n+2)-2\cdot G(n)+G(n-2) \tag{17}$$

This difference calculation may be performed with a different width of moving window. The width of the difference window relative to that of the mass peak width at half height is preferably between 33% and 100%, and more preferably about 67%.

The second differential H2($n$) is preferably used to locate the start and end times of mass peaks observed in the continuum mass spectrum. The start time T1 of a mass peak is preferably the stepping interval after which the second differential falls below zero. The end time T2 of a mass peak is preferably the stepping interval before which the second differential rises above zero. Alternatively, the start time T1 of a mass peak is preferably the stepping interval before which the second differential falls below zero and the end time T2 of the mass peak is preferably the stepping interval after which the second differential rises above zero. In yet another embodiment the start time T1 of the mass peak is interpolated from the stepping intervals before and after the second differential falls below zero, and the end time T2 of the peak is interpolated from the stepping interval before and after the second differential rises above zero.

In a less preferred embodiment the mass peak start time T1 and the mass peak end time T2 are derived from the stepping times for which the value of the integration procedure output G rises above a threshold level and subsequently falls below a threshold level.

Once the start time and the end time of a mass peak have been determined values corresponding to the intensity and moment of the mass peak within the bounded region are preferably determined. The intensity and moment of the mass peak are preferably determined from the intensities and time of flights of the voltage peaks bounded by the mass peak start time and the mass peak end time.

The mass peak intensity corresponds to the sum of the intensity values bounded by the mass peak start time and the mass peak end time, and may be described by the following equation:

$$A = \sum_{t=T1}^{t=T2} I_t \tag{18}$$

wherein A is the mass peak intensity, $I_t$ is the intensity of the voltage peak with time of flight t, T1 is the start time of the mass peak and T2 is the end time of the mass peak.

The moment of each mass peak is determined from the sum of the moments of all the voltage peaks bounded by the mass peak start time and the mass peak end time.

The moment $B_1$ of the mass peak with respect to the start of the peak is determined from the intensity and time difference of each voltage peak with respect to the peak start, and is given by the following equation:

$$B_1 = \sum_{t=T1}^{t=T2} I_t \cdot (t - T1) \tag{19}$$

For completeness, the moment $B_2$ with respect to the end of the peak is given by the following equation:

$$B_2 = \sum_{t=T1}^{t=T2} I_t \cdot (T2 - t) \tag{20}$$

However, there is no particular advantage to be gained by calculating the moment $B_2$ with respect to the end of the peak as opposed to calculating the moment $B_1$ with respect to the start of the peak.

The representative or average time Tpk associated with the mass peak is given by:

$$Tpk = \left(T1 + \frac{B_1}{A}\right) = \left(T2 - \frac{B_2}{A}\right) \tag{21}$$

The precision of the calculated value of Tpk is dependent on the precision of the division computed in Equation 21 and may be computed to whatever precision is required.

The values Tpk and A for each mass peak are preferably stored as a list within a computer memory. The list of mass peaks may be assigned masses or mass to charge ratios using their time of flights and a relationship between time of flight and mass derived from a calibration procedure. Such calibration procedures are well known in the art.

The simplest form of a time to mass relationship for a Time of Flight mass spectrometer is shown below:

$$M=k\cdot(t+t^*)^2 \tag{22}$$

wherein t* is an instrumental parameter equivalent to an offset in flight time, k is a constant and M is the mass to charge ratio at time t.

More complex calibration algorithms may be applied to the data. For example, the calibration procedures disclosed in GB-2401721 (Micromass) or GB-2405991 (Micromass) may be used.

According to a less preferred embodiment the time values associated with each voltage peak may be converted to mass values, as described above, prior to the integration procedure and prior to the conversion of the voltage peak intensity time pairs into a single continuum mass spectrum. The integration window W(m) and/or the stepping interval S(m) may each be set to be constant values or functions of mass. For example, the stepping interval function S(m) may be set such as to give a substantially constant number of steps over each mass spectral peak.

This method has a several advantages over other known methods. The precision and accuracy of the measurement is preferably improved relative to other arrangements which may use a simple measurement of the maxima or apex of the signal.

This is a result of using substantially the entire signal recorded within the measurement as opposed to just measuring at or local to the apex. The preferred method also gives an accurate representation of the mean time of arrival when the ion signal is asymmetrical due to two or more ions arriving at substantially similar times. Signal maxima measurements will no longer reflect the mean arrival time or relative intensity of these signals.

The value of time t associated with each detected ion signal may be calculated with a precision higher than the original precision imposed by the digitisation rate of the Analogue to Digital Converter. For example, for a voltage peak width at half height of 2.5 ns, and an Analogue to Digital Converter digitisation rate of 2 GHz the time of flight may typically be calculated to a precision of ±125 ps or better.

An important aspect of the preferred embodiment of the present invention is that the voltage peak times may be stored with a precision which is substantially higher than that afforded by the ADC digitisation intervals or a simple fraction of the ADC digitisation intervals.

According to one embodiment of the present invention the data may be processed so as to result in a final spectrum wherein the number of step intervals over each mass spectral peak (ion arrival envelope) is substantially constant. It is known that for time of flight spectra recorded using a constant digitisation interval or which are constructed from many time of flight spectra using a histogramming technique with constant bin widths, the number of points per mass peak (ion arrival envelope) increases with mass. This effect can complicate further processing and can lead to an unnecessary increase in the amount of data to be stored. According to this embodiment there are no constraints over the choice of stepping interval and the stepping interval function may be set to obtain a constant number of steps across each mass peak.

The following analysis illustrates an example of such a stepping interval function. Apart from at low mass to charge ratio values the resolution R of an orthogonal acceleration Time of Flight mass spectrum is approximately constant with mass to charge ratio:

$$R = \frac{t}{2\Delta t} \tag{23}$$

wherein R is the mass resolution, t is the time of flight of the mass peak and Δt is the width of the ion arrival envelope forming the mass peak.

Where the resolution is approximately constant the peak width is proportional to the time of flight t:

$$\Delta t = \frac{t}{2R} \tag{24}$$

Accordingly, in order to obtain approximately constant number of steps across a mass peak, the step interval S(t) needs to increase approximately in proportion to the time of flight t.

For mass spectrometers where there is a more complex relationship between resolution and mass it may be desirable to use a more complex function relating the stepping intervals S(t) and time of flight t.

The preferred embodiment of the present invention will now be illustrated with reference to some experimental data.

FIG. 1 shows a portion of a mass spectrum of a sample of polyethylene glycol. The sample was ionised using a Matrix Assisted Laser Desorption Ionisation (MALDI) ion source. The mass spectrum was acquired using an orthogonal acceleration Time of Flight mass analyser. The mass spectrum shown in FIG. 1 is the result of simply combining or summing 48 individual time of flight spectra which were generated by firing the laser 48 times i.e. 48 separate acquisitions were obtained. The spectra were acquired or recorded using a 2 GHz 8-bit Analogue to Digital Converter.

Figure 2:
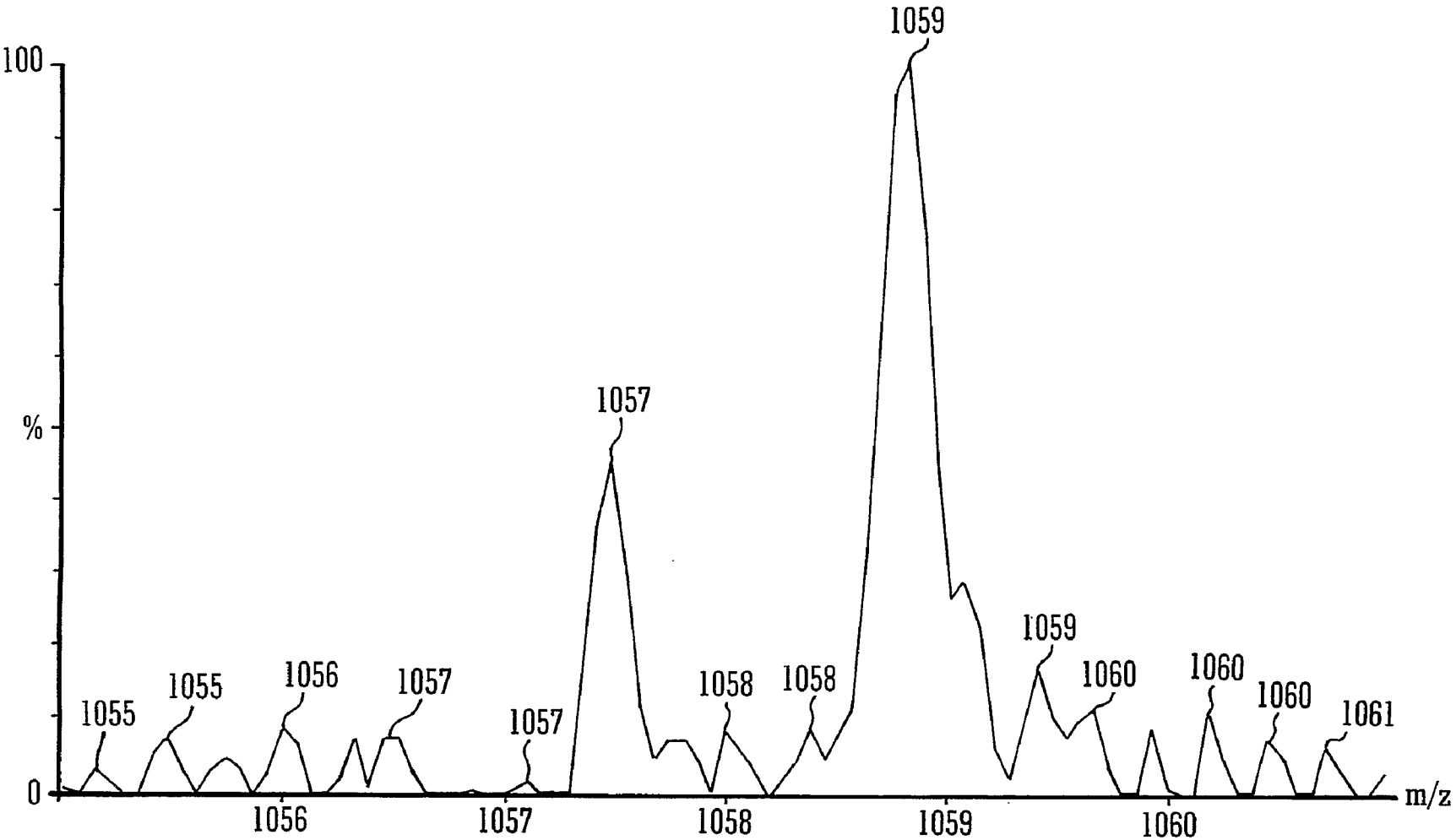
FIG. 2 shows a spectrum which was acquired from a single experimental run and which was summed together with other spectra to form the composite mass spectrum shown in FIG. 1.

FIG. 2 shows an individual spectrum across the same mass to charge ratio range as shown in FIG. 1. The signals arise from individual ions arriving at the ion detector.

Figure 3:
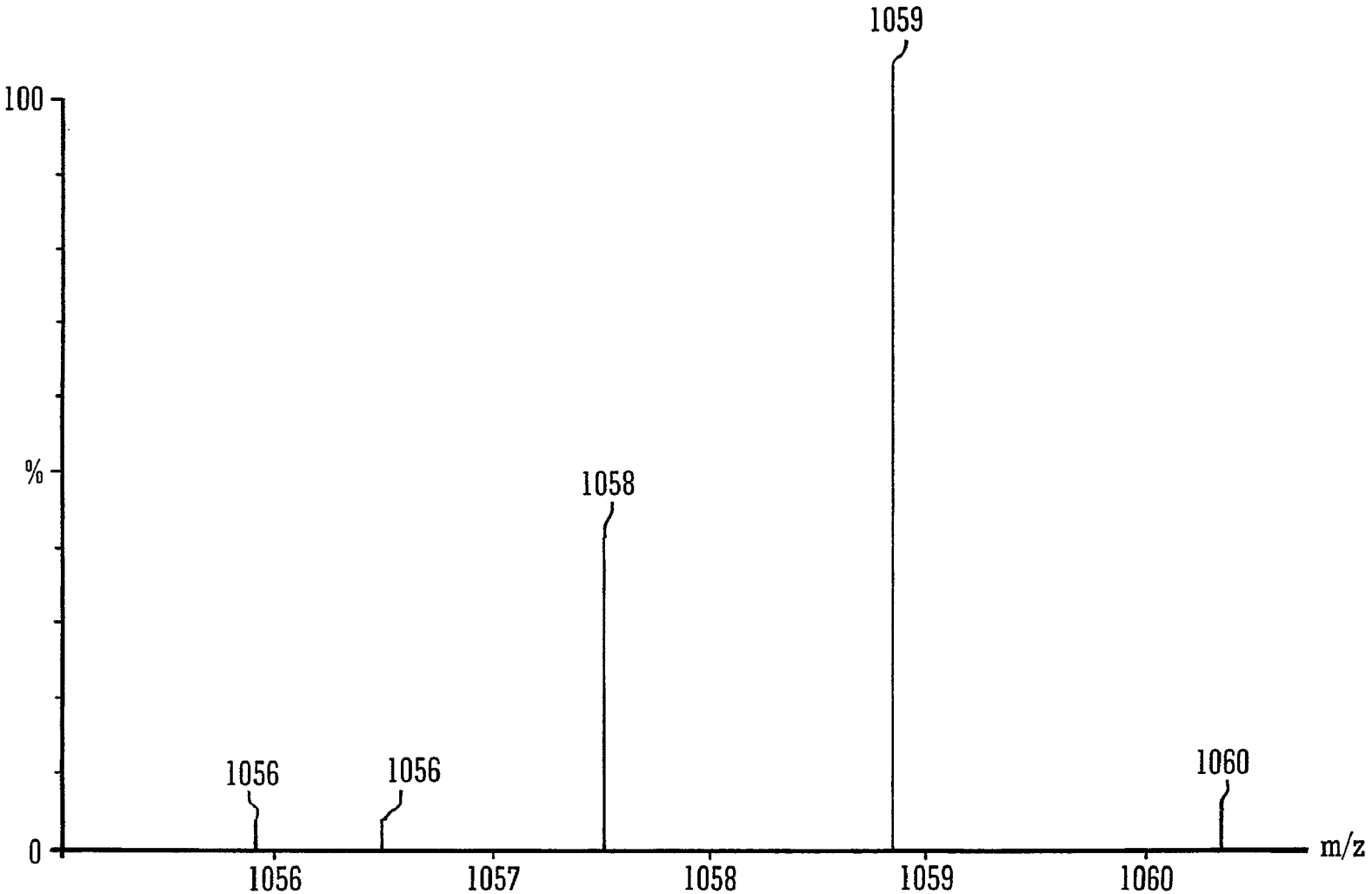
FIG. 3 shows the spectrum shown in FIG. 2 after being processed according to the preferred embodiment to provide data in the form of mass to charge and intensity pairs.

FIG. 3 shows the result of processing the individual spectrum shown in FIG. 2 according to an embodiment of the present invention by using a two pass moving average smooth (Equation 1) with a smoothing window of seven time digitisation points. The smoothed signal was then differentiated twice using a three-point moving window difference calculation (Equation 4). The zero crossing points of the second differential were determined as being the start and the end points of the signals of interest within the spectrum. The centroid of each signal was determined using Equation 12. The time determined by Equation 13 and the intensity for each detected signal was recorded. The resulting processed mass spectral data is shown in FIG. 3 in the form of intensity-time pairs. The precision of the determination of the centroid for each ion arrival was higher than the precision afforded by the individual time intervals of the Analogue to Digital Converter.

Figure 4:
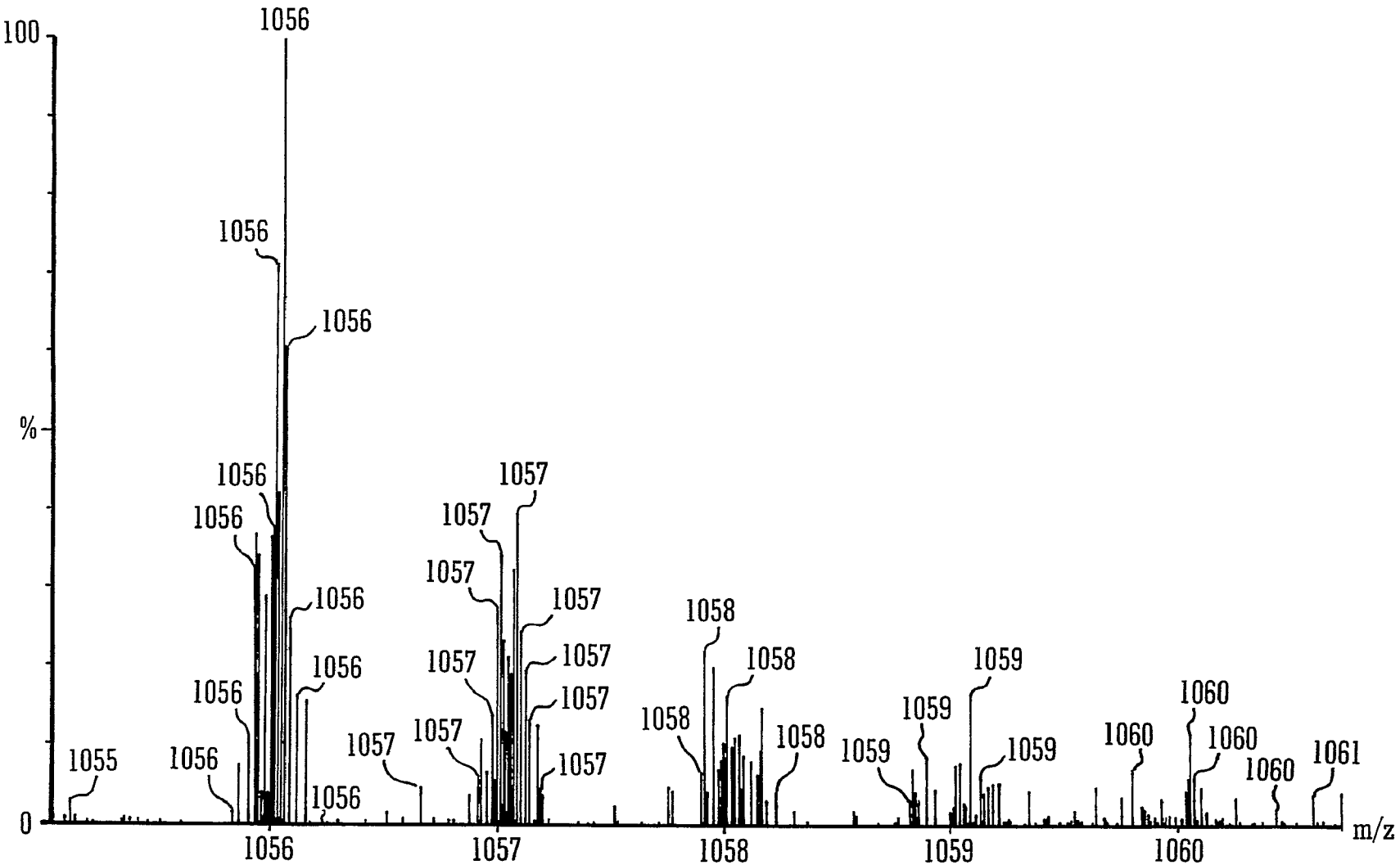
FIG. 4 shows the result of summing or combining 48 separate processed time of flight mass spectra.

FIG. 4 shows the result according to the preferred embodiment of combining the 48 individual spectra which have each been pre-processed using the method described above in relation to FIG. 3. The 48 sets of data comprising intensity-time pairs were combined to form a composite set of data comprising a plurality of intensity-time pairs.

Figure 5:
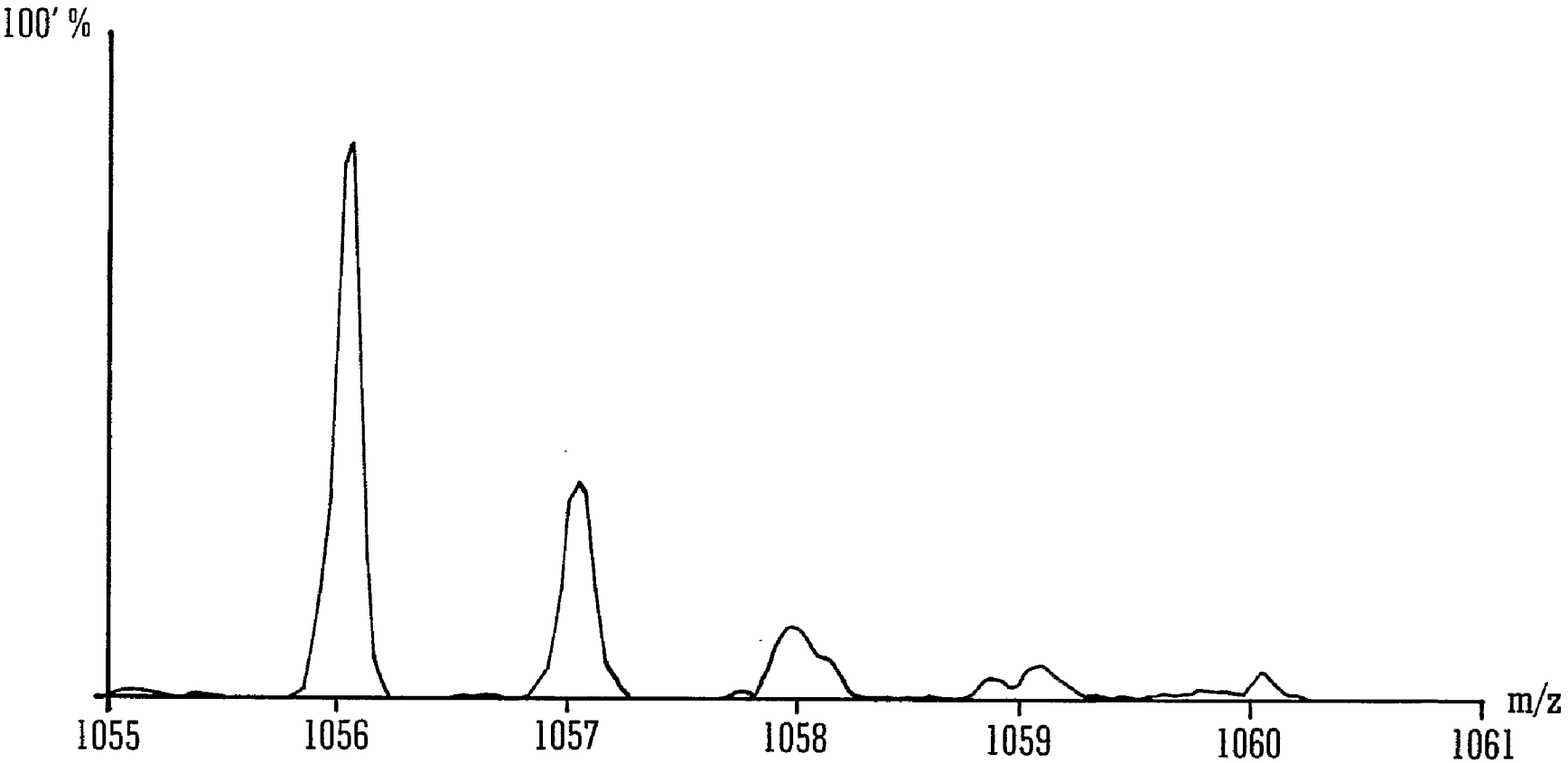
FIG. 5 shows the result of integrating the pairs of data shown in FIG. 4 using a boxcar integration algorithm in order to form a continuum mass spectrum.

Once a composite set of data as shown in FIG. 4 has been provided or obtained then according to the preferred embodiment the composite data set is preferably integrated using two passes of a boxcar integration algorithm. According to an embodiment the integration algorithm may have a width of 615 ps and step intervals of 246 ns. The resulting integrated and smoothed data set or continuum mass spectrum is shown in FIG. 5. It can be seen that the mass resolution and the signal to noise within the spectrum is greatly improved compared to the combined raw Analogue to Digital Converter data as shown in FIG. 1.

Figure 6:
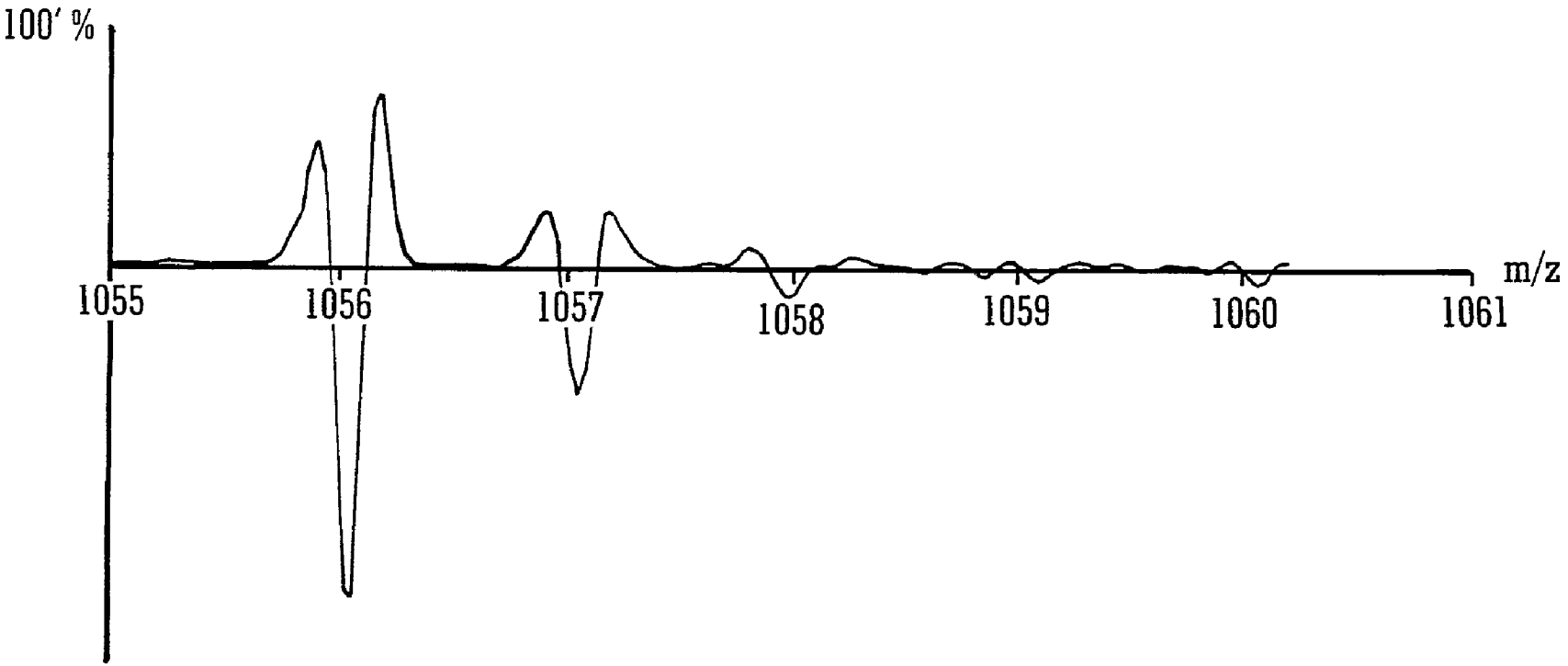
FIG. 6 shows the second differential of the continuum mass spectrum shown in FIG. 5.

FIG. 6 shows the second differential of the single processed continuum mass spectrum shown in FIG. 5. The second differential was derived using a moving window of 1.23 ns. The zero crossing points of the second differential were used to determine the start and end points of the mass peaks observed within the continuum mass spectrum.

Figure 7:
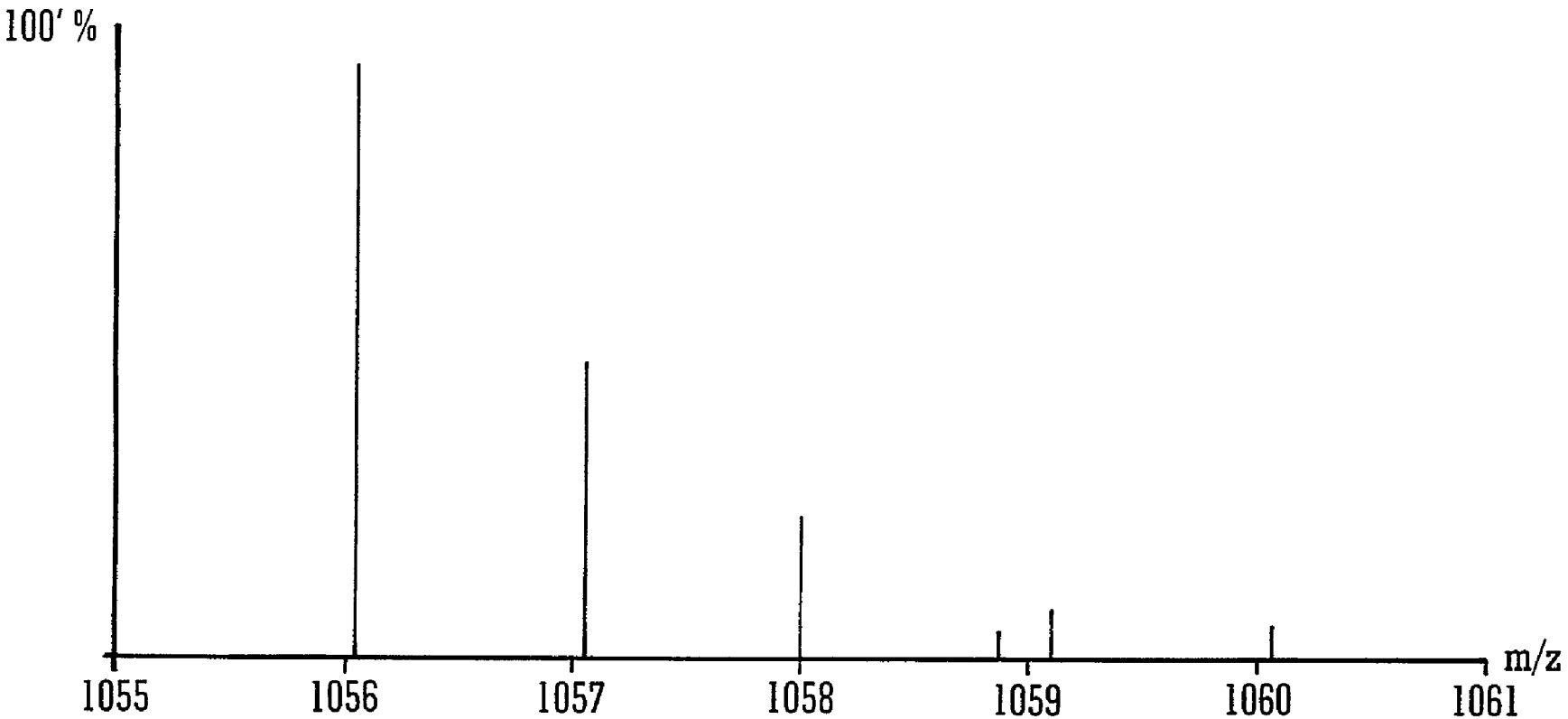
FIG. 7 shows the resultant mass peaks derived from the data shown in FIG. 4 by reducing the continuum mass spectrum shown in FIG. 5 to a discrete mass spectrum.

FIG. 7 shows the final mass to charge ratio and intensity values as a result of integrating the 48 spectra shown in FIG. 4 into a continuum mass spectrum and then reducing the continuum mass spectrum to a discrete mass spectrum. The time of flight for each mass peak was determined using Equation 21 and the intensity for each mass peak was determined using Equation 18.

For all the spectra shown in FIGS. 1-7 the time axis has been converted into a mass to charge ratio axis using a time to mass relationship derived from a simple calibration procedure. At the masses shown the ADC digitisation interval of 0.5 ns is approximately equivalent to 0.065 Daltons in mass.

According to the preferred embodiment the time of flight detector (secondary electron multiplier) may comprise a microchannel plate, a photomultiplier or an electron multiplier or combinations of these types of detectors.

The digitisation rate of the ADC may be uniform or non-uniform.

According to an embodiment of the present invention it may be desirable to combine the calculated intensity I and time of flight t of several voltage peaks into a single representative peak. If the number of voltage peaks in a spectrum is large and/or the number of spectra is large, then the final total number of voltage peaks may become very large. It may therefore sometimes be advantageous to reduce this number in order to reduce the memory requirements and the subsequent processing time.

Single representative peaks are preferably composed of constituent voltage peaks with a sufficient narrow range of times that the integrity of the data is not compromised and the mass spectra maintain their resolution. It is desirable that mass peak start and end times can still be determined with sufficient accuracy such that resultant mass peaks are composed of substantially the same voltage peaks that they would have had not this merging of peaks taken place. The single representative peak preferably has an intensity and time of flight that accurately represents the combined intensity and the combined weighted time of flight of all the constituent voltage peaks. The intensity and time of flight of the resultant mass peak is preferably substantially the same irrespective of whether or not some merging of voltage peaks has occurred in the processing of the data.

Although the present invention has been described with reference to preferred embodiments, it will be understood by those skilled in the art that various changes in form and detail may be made to the particular embodiments discussed above without departing from the scope of the invention as set forth in the accompanying claims.

The invention claimed is:

1. A method of mass spectrometry comprising:

digitising a first signal output from an ion detector to produce a first digitised signal;

determining or obtaining a second differential of said first digitised signal; and determining the arrival time of one or more ions from said second differential of said first digitised signal;

wherein said step of determining the arrival time of one or more ions from said second differential of said first digitised signal comprises determining zero crossing points of said second differential of said first digitised signal, determining or setting a start time of an ion arrival event as corresponding to a digitisation interval which is immediately prior or subsequent to the time when said second differential of said first digitised signal falls below zero, and determining or setting an end time t2 of an ion arrival event as corresponding to a digitisation interval which is immediately prior or subsequent to the time when said second differential of said first digitised signal rises above zero.

2. The method as claimed in claim 1, wherein said first signal comprises an output signal, a voltage signal, an ion signal, an ion current, a voltage pulse or an electron current pulse.

3. The method as claimed in claim 1, further comprising determining whether a portion of said first digitised signal falls below a threshold and resetting said portion of said first digitised signal to zero if said portion of said first digitised signal falls below said threshold.

4. The method as claimed in claim 1, further comprising smoothing said first digitised signal.

5. The method as claimed in claim 1, further comprising determining the intensity of one or more peaks present in said first digitised signal which correspond to one or more ion arrival events, wherein the step of determining the intensity of one or more peaks present in said first digitised signal comprises determining the area of said one or more peaks present in said first digitised signal bounded by said start time t1 and by said end time t2.

6. The method as claimed in claim 1, further comprising determining the moment of one or more peaks present in said first digitised signal which correspond to one or more ion arrival events, wherein the step of determining the moment of one or more peaks present in said first digitised signal which correspond to one or more ion arrival events comprises determining the moment of a peak bounded by said start time t1 and by said end time t2.

7. The method as claimed in claim 1, further comprising determining the centroid time of one or more peaks present in said first digitised signal which correspond to one or more ion arrival events.

8. The method as claimed in claim 1, further comprising determining the average or representative time of one or more peaks present in said first digitised signal which correspond to one or more ion arrival events.

9. The method as claimed in claim 1, further comprising storing or compiling a list of the average or representative times or intensities of one or more peaks present in said first digitised signal which correspond to one or more ion arrival events.

10. The method as claimed in claim 1, further comprising:

digitising one or more further signals output from said ion detector to produce one or more further digitised signals;

determining or obtaining a second differential of said one or more further digitised signals; and determining the arrival time of one or more ions from said second differential of said one or more further digitised signals.

11. The method as claimed in claim 10, wherein said step of digitising said one or more further signals comprises digitising at least 5, 10, 15, 20, 25, 30, 35, 40, 45, 50, 55, 60, 65, 70, 75, 80, 85, 90, 95, 100, 200, 300, 400, 500, 600, 700, 800, 900, 1000, 2000, 3000, 4000, 5000, 6000, 7000, 8000, 9000 or 10000 signals from said ion detector, each signal corresponding to a separate experimental run or acquisition.

12. The method as claimed in claim 10, further comprising combining or integrating data relating to an average or representative time or intensity of said first digitised signal relating to one or more ion arrival events with data relating to average or representative times or intensities of said one or more further digitised signals relating to one or more ion arrival events.

13. The method as claimed in claim 12, further comprising using a moving average integrator algorithm, boxcar integrator algorithm, Savitsky Golay algorithm or Hites Biemann algorithm to combine or integrate data relating to said average or representative time or intensity of said first digitised signal relating to one or more ion arrival events with data relating to said average or representative times or intensities of said one or more further digitised signals relating to one or more ion arrival events.

14. The method as claimed in claim 12, further comprising providing or forming a continuum mass spectrum.

15. The method as claimed in claim 14, further comprising determining or obtaining a second differential of said continuum mass spectrum and determining the mass or mass to charge ratio of one or more ions or mass peaks from said second differential of said continuum mass spectrum.

16. The method as claimed in claim 15, wherein said step of determining the mass or mass to charge ratio of one or more ions or mass peaks from said second differential of said continuum mass spectrum comprises determining one or more zero crossing points of said second differential of said continuum mass spectrum.

17. The method as claimed in claim 16, further comprising determining or setting a start point T1 of a mass peak as corresponding to a stepping interval which is immediately prior or subsequent to the point when said second differential of said continuum mass spectrum falls below zero or another value.

18. The method as claimed in claim 16, further comprising determining or setting an end point T2 of a mass peak as corresponding to a stepping interval which is immediately prior or subsequent to the point when said second differential of said continuum mass spectrum rises above zero or another value.

19. The method as claimed in claim 14, further comprising determining the intensity of one or more ions or mass peaks from said continuum mass spectrum.

20. The method as claimed in claim 14, further comprising determining the moment of one or more ions or mass peaks from said continuum mass spectrum.

21. The method as claimed in claim 14, further comprising determining the centroid time of one or more ions or mass peaks from said continuum mass spectrum.

22. The method as claimed in claim 14, further comprising determining the average or representative time of one or more ions or mass peaks from said continuum mass spectrum.

23. The method as claimed in claim 14, further comprising displaying or outputting a mass spectrum, wherein said mass spectrum comprises a plurality of mass spectral data points wherein each data point is considered as representing a species of ion and wherein each data point comprises an intensity value and a mass or mass to charge ratio value.

24. Apparatus comprising:

means arranged to digitise a first signal output from an ion detector to produce a first digitised signal;

means arranged to determine or obtain a second differential of said first digitised signal; and means arranged to determine the arrival time of one or more ions from said second differential of said first digitised signal;

wherein, in use, said means arranged to determine the arrival time of one or more ions from said second differential of said first digitised signal determines one or more zero crossing points of said second differential of said first digitised signal, determines or sets a start time t1 of an ion arrival event as corresponding to a digitisation interval which is immediately prior or subsequent to the time when said second differential of said first digitised signal falls below zero, and determines or sets an end time t2 of an ion arrival event as corresponding to a digitisation interval which is immediately prior or subsequent to the time when said second differential of said first digitised signal rises above zero.

25. A mass spectrometer comprising the apparatus as claimed in claim 24.

* * * * *